US006632578B2

(12) United States Patent
Niino et al.

(10) Patent No.: US 6,632,578 B2
(45) Date of Patent: Oct. 14, 2003

(54) ELECTROPHOTOGRAPHIC LIGHT-RECEIVING MEMBER AND PROCESS FOR ITS PRODUCTION

(75) Inventors: Hiroaki Niino, Nara-ken (JP); Satoshi Kojima, Kyoto-fu (JP); Shinji Tsuchida, Kyoto-fu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/255,684

(22) Filed: Sep. 27, 2002

(65) Prior Publication Data

US 2003/0143478 A1 Jul. 31, 2003

Related U.S. Application Data

(62) Division of application No. 08/780,006, filed on Dec. 23, 1996, now abandoned.

(30) Foreign Application Priority Data

Dec. 26, 1995 (JP) ..... 7/350769
Dec. 4, 1996 (JP) ..... 8/337662

(51) Int. Cl.[7] ..... G03G 5/00

(52) U.S. Cl. ..... 430/128; 430/133; 430/134; 430/57.4; 430/59.1

(58) Field of Search ..... 430/128, 133, 430/134, 57.2, 57.4, 57.7, 59.1

(56) References Cited

U.S. PATENT DOCUMENTS

| | | | | |
|---|---|---|---|---|
| 4,265,991 A | | 5/1981 | Hirai et al. | 430/64 |
| 4,409,311 A | | 10/1983 | Kawamura et al. | 430/95 |
| 4,607,936 A | | 8/1986 | Miyakawa et al. | 355/3 DR |
| 4,650,736 A | | 3/1987 | Saitoh et al. | 430/57 |
| 4,696,844 A | | 9/1987 | Spector | 428/46 |
| 4,705,733 A | | 11/1987 | Saitoh et al. | 430/57 |
| 4,735,883 A | | 4/1988 | Honda et al. | 430/69 |
| 4,788,120 A | | 11/1988 | Shirai et al. | 430/66 |
| 5,382,487 A | | 1/1995 | Fukuda et al. | 430/57 |
| 5,397,737 A | | 3/1995 | Mahan et al. | 437/101 |
| 5,421,909 A | | 6/1995 | Ishikawa et al. | 136/256 |
| 5,480,750 A | | 1/1996 | Kawada et al. | 430/31 |
| 5,738,963 A | * | 4/1998 | Niino | 430/57.7 |
| 5,846,612 A | * | 12/1998 | Takaki et al. | 430/128 |
| 6,090,513 A | * | 7/2000 | Niino et al. | 430/65 |

FOREIGN PATENT DOCUMENTS

| | | |
|---|---|---|
| JP | 57 115556 | 7/1982 |
| JP | 60 067951 | 4/1985 |
| JP | 60 95551 | 5/1985 |
| JP | 62 083470 | 4/1987 |

* cited by examiner

*Primary Examiner*—Christopher Rodee
(74) *Attorney, Agent, or Firm*—Fitzpatrick, Cella, Harper & Scinto

(57) ABSTRACT

A process for producing an electrophotographic light-receiving member having a conductive support and a light-receiving member having a photoconductive layer formed on the surface of the conductive support and composed of a non-single crystal material containing silicon atoms as a main component, hydrogen atoms and/or halogen atoms. The photoconductive layer is formed at a flow rate (X) sccm of n Si supply gas and a discharge space volume (Z) $cm^3$ satisfying (A) and a flow rate (X) sccm of the Si supply gas and density (Y) $W/cm^3$ of the electric power input to the discharge space satisfying the following relation (B) wherein $$3\times10^{-3} \leqq X/Z \leqq 1\times10^{-2} \quad \text{(A) and}$$

$$3\times10^{-4} \leqq Y/X \leqq 7\times10^{-4} \quad \text{(B).}$$

2 Claims, 3 Drawing Sheets

ELECTROPHOTOGRAPHIC LIGHT-RECEIVING MEMBER AND PROCESS FOR ITS PRODUCTION

This application is a division of application Ser. No. 08/780,006, filed on Dec. 23, 1996 abandoned.

BACKGROUND OF THE INVENTION

1. Field of the Invention

The present invention relates to an electrophotographic light-receiving member having a sensitivity to electromagnetic waves such as light (which herein refers to light in a broad sense and indicates ultraviolet rays, visible rays, infrared rays, X-rays, γ-rays, etc.), and also relates to a process for its production.

2. Description of the Related Art

In the field of image formation, photoconductive materials that form light-receiving layers in light-receiving members are required to have properties such that they are highly sensitive, have a high SN ratio [light current (Ip)/dark current (Id)], have absorption spectra suited to spectral characteristics of electromagnetic waves to be radiated, have a high response to light, have the desired dark resistance and are harmless to human bodies when used. In particular, in the case of electrophotographic light-receiving members set in electrophotographic apparatus used in offices, their safety during use an important point.

Photoconductive materials having good properties in these respects include amorphous silicon hydrides (hereinafter "a-Si:H"). For example, U.S. Pat. No. 4,265,991 discloses its application in electrophotographic light-receiving members. In such electrophotographic light-receiving members having a-Si:H, it is common to form photoconductive layers comprised of a-Si, by film forming processes such as vacuum deposition, sputtering, ion plating, heat-assisted CVD, light-assisted CVD and plasma-assisted CVD while heating conductive to from 50° C. to 350° C. In particular, the plasma-assisted CVD, i.e., a process in which material gases are decomposed by direct-current, high-frequency or microwave glow discharging to form a-Si deposited films on the support, has been put into practical use as a preferred process.

U.S. Pat. No. 5,382,487 discloses an electrophotographic light-receiving member comprising a conductive support and an amorphous silicon photoconductive layer containing a halogen atom as a constituent (hereinafter "a-Si:X" photoconductive layer). This publication discloses that incorporation of 1 to 40 atom % of halogen atoms into a-Si enables achievement of a high thermal resistance, and also electrical and optical properties preferable for a photoconductive layer of an electrophotographic light-receiving member.

Japanese Patent Application Laid-Open No. 57-115556 also discloses a technique in which a surface barrier layer formed of a non-photoconductive amorphous material containing silicon atoms and carbon atoms is provided on a photoconductive layer formed of an amorphous material mainly composed of silicon atoms, in order to achieve improvements in photoconductive members having a photoconductive layer formed of an a-Si deposited film, in respect of their electrical, optical and photoconductive properties such as dark resistance, photosensitivity and response to light and service environmental properties such as moisture resistance and also in respect of stability with time. Japanese Patent Publication Laid-Open No. 60-67951 also discloses a technique concerning a photosensitive member laminated with a light-transmitting insulating overcoat layer containing amorphous silicon, carbon, oxygen and fluorine. U.S. Pat. No. 4,788,120 still also discloses a technique in which an amorphous material containing silicon atoms, carbon atoms and 41 to 70 atom % of hydrogen atoms as constituents is used to form a surface layer.

U.S. Pat. No. 4,409,311 further discloses that a highly sensitive and highly resistant, electrophotographic photosensitive member can be obtained by using in a photoconductive layer an a-Si:H containing 10 to 40 atom % of hydrogen atoms and having absorption peaks at 2,100 $cm^{-1}$ and 2,000 $cm^{-1}$ in an infrared absorption spectrum which peaks are in a ratio of 0.1 to 1.7 as the coefficient of absorption. Japanese Patent Publication Laid-Open No. 62-83470 further discloses a technique in which a high quality image without after image can be obtained by reducing, to 0.09 eV or less, the characteristic energy of the exponential tail in a light absorption spectrum of a photoconductive layer of an electrophotographic photosensitive member.

Meanwhile, U.S. Pat. No. 4,607,936 discloses a technique in which, aiming at an improvement in image quality of an amorphous silicon photosensitive member, image forming steps such as charging, exposure, development and transfer are carried out while maintaining temperature at 30 to 40° C. in the vicinity of the surface of the photosensitive member to thereby prevent the surface of the photosensitive member from undergoing a decrease in surface resistance which is due to water absorption on that surface and also smeared images from occurring concurrently therewith.

These techniques have achieved improvements in electrical, optical and photoconductive properties and service environmental properties of electrophotographic light-receiving members, and also have concurrently brought about an improvement in image quality.

The electrophotographic light-receiving members having a photoconductive layer comprising an a-Si material have individually achieved improvements in properties in respect of electrical, optical and photoconductive properties such as dark resistance, photosensitivity and response to light and service environmental properties and also in respect of stability with time, and durability. Under existing circumstances however, there is room for further improvements to make overall properties better. In particular, there is a rapid progress in making electrophotographic apparatus have higher image quality, higher speed and higher durability, and the electrophotographic light-receiving members are required to be more improved in electrical properties and photoconductive properties and also to be significantly decreased in variations in their properties in every environment while being improved in charge performance and sensitivity.

Then, as a result of improvements made on optical exposure devices, developing devices, transfer devices and the like in order to improve image characteristics of electrophotographic apparatus, the electrophotographic light-receiving members are now also required to be more improved in performance than ever.

Under such circumstances, although the conventional techniques as described above have made it possible to improve properties to a certain degree in respect of the above-described subjects, they cannot be said to be satisfactory in regard to additional enhancement in charge performance and image quality. In particular, as the subjects for making amorphous silicon light-receiving members have much higher image quality, it has now been sought to further improve the charge performance and decrease variations in the charge performance due to changes in environmental temperature and exposure memory such as blank memory and ghost. For example, an electrophotographic apparatus is miniaturized year by year from the viewpoint of space saving, and the space around a photosensitive member in the electrophotographic apparatus tends to be decreased concurrently. As a result, although a charger is miniaturized, it becomes difficult to increase the capacity of a power source for the charger from the viewpoint of power consumption, thereby causing difficulties in ensuring a sufficient surface potential.

For example, hitherto, in order to prevent smeared images caused by photosensitive members, a drum heater is set inside a copying machine to keep the surface temperature of a photosensitive member at about 40° C., as disclosed in Japanese Patent Publication Laid-Open No. 60-95551. In conventional photosensitive members, however, the dependence of charge performance on temperature, so-called temperature-dependent properties, which is ascribable to formation of pre-exposure carriers or heat-energized carriers is so great that, in the actual service environment inside copying machines, photosensitive members were sometimes used with lower charge performance than that originally possessed by the photosensitive members. For example, the charge performance may drop by nearly 100 V in the state where the photosensitive members are heated to about 40° C. by a drum heater, compared with the case when used at room temperature.

At night when copying machines are not used, the drum heater is kept electrified in conventional cases so as to prevent the smeared images that are caused when ozone products formed by corona discharging of the charger are adsorbed on the surface of a photosensitive member. Nowadays, however, it has become popular not to electrify copying machines at night for the purpose of saving natural resources and saving electric power. When copies are continuously taken in such a state, the surrounding temperature of the photosensitive member inside a copying machine gradually rises to make charge performance lower with a rise of the temperature of the photosensitive member, causing the problem of a change in image density during copying.

On the other hand, when the same original is repeatedly continuously copied, blank memory and so-called ghost phenomenon have now become problems to the further improvement of image quality; the blank memory being a phenomenon which causes a density difference on copied images, caused by the effects of so-called blank exposure that is applied to the photosensitive member in order to save the amount of the toner used, and the ghost being a phenomenon in which an image remaining after the image exposure in previous copying is produced on an image in the subsequent copying.

Accordingly, in designing electrophotographic light-receiving members, it is required to achieve improvements from the overall viewpoints of layer configuration and chemical composition of each layer of electrophotographic light-receiving members so that the problems as described above can be solved, and also to achieve a much more improvement in properties of the a-Si materials themselves.

SUMMARY OF THE INVENTION

The present invention aims at solving the problems involved in electrophotographic light-receiving members having the conventional light-receiving layer formed of a-Si as described above.

That is, a main object of the present invention is to provide an electrophotographic light-receiving member which is substantially always stable almost without impact on electrical, optical and photoconductive properties in service environments, has a superior resistance to exposure fatigue, has superior durability and moisture resistance without causing any deterioration when repeatedly used, can be almost free from residual potential and also can achieve a good image quality, and a process for its production.

Another object of the present invention is to provide an electrophotographic light-receiving member in which temperature characteristics and exposure memory are decreased while significantly improving charge performance and sensitivity, to significantly improve image quality, and a process for its production.

The present invention provides an electrophotographic light-receiving member comprising a conductive support and a light-receiving layer having a photoconductive layer formed on the surface of the conductive support and composed of a non-single crystal material containing silicon atoms as a main component and hydrogen atoms and/or halogen atoms; wherein the non-single crystal material, which constitutes the photoconductive layer, has an optical band gap of 1.8 eV to 1.85 eV, and the characteristic energy of exponential tail obtained from a light absorption spectrum thereof is 50 meV to 55 meV.

The present invention also provides a process for producing an electrophotographic light-receiving member comprising a conductive support and a light-receiving layer formed on the surface of the conductive support and having a photoconductive layer composed of a non-single crystal material containing silicon atoms as a main component and hydrogen and/or halogen atoms, the process comprising forming the photoconductive layer under conditions in which the flow rate (X) [sccm] of a gas for supplying Si and a discharge space volume (Z) [$cm^3$] satisfy the following relation (A), and the flow rate (X) [sccm] of the Si supplying gas and the density (Y) [$W/cm^3$] of power supplied to the discharge space satisfy the following relation (B):

$$3\times10^{-3} \leq X/Z \leq 1\times10^{-2} \quad \text{(A)}$$

$$3\times10^{-4} \leq Y/Z \leq 7\times10^{-4} \quad \text{(B)}$$

In order to solve the above problems, the inventors intensively researched the relations between the local distribution of amorphous silicon in a band gap and charge performance and exposure memory with attention to the optical band gap of a photoconductive layer and the behavior of carriers in the photoconductive layer. As a result, it was found that the objects of the present invention can be achieved by controlling the local distribution in the photoconductive layer while enlarging the optical band gap. Namely, it was found that, with regard to a light-receiving member having a photoconductive layer composed of a non-single crystal material containing silicon atoms as a main component and hydrogen atoms and/or halogen atoms, a light-receiving member manufactured based on a design for specifying the layer structure thereof exhibits excellent practical characteristics, and is superior to conventional light-receiving members in all points, particularly, excellent in characteristics as an electrophotographic light-receiving member.

The present invention has been achieved on the basis of the finding. The light-receiving member of the present invention has a photoconductive layer composed of a non-single crystal material containing silicon atoms as a main component and hydrogen and/or halogen atoms, wherein the hydrogen content, the optical band gap and the characteristic energy of exponential tail obtained from a light absorption spectrum of the photoconductive layer are controlled so as to improve charge performance and temperature-dependent properties and prevent the occurrence of exposure memory, thereby exhibiting good characteristics.

In the present invention, "exponential tail" represents a tail on the low-energy side of a light absorption spectrum, and "characteristic energy" means the gradient of the exponential tail.

This will be described in detail below with reference to FIG. 2.

FIG. 2 shows an example of a sub-gap light absorption spectrum of amorphous silicon in which photon energy hv is shown on the abscissa, and a logarithm of absorption coefficient $\alpha$ is shown on the ordinate. This spectrum is roughly divided into two parts including part B (exponential tail or Urbach tail) where the absorption coefficient $\alpha$ exponentially changes, i.e., linearly changes, with photon energy hv, and part A where absorption coefficient $\alpha$ shows low dependence on photon energy hv.

Part B corresponds to the light absorption caused by optical transition from the tail level on the valence band side to the conduction band in amorphous silicon. In part B, the exponential dependence of absorption coefficient $\alpha$ on hv is represented by the following equation:

$$\alpha = a_0 \exp(hv/Eu)$$

If both sides of this equation are transformed to logarithms, the following equation is obtained:

$$\ln \alpha = (1/Eu) \cdot hv + \alpha 1$$

wherein $\alpha 1 = \ln \alpha_0$.

Therefore, the inverse (1/Eu) of characteristic energy Eu represents the gradient of absorption coefficient $\alpha$ in part B. Since characteristic energy Eu corresponds to the characteristic energy of an exponential energy distribution in the tail level on the valence band side, a low value of Eu indicates a low tail level on the valence band side.

In a band gap of a-Si:H, there are generally a tail (bottom) level ascribable to a structural disorder of Si—Si bonds and a deep level ascribable to structural imperfections of Si unbonded arms (dangling bonds) or the like. These levels are known to act as capture and recombination centers of electrons and holes to cause deterioration in properties of devices.

As methods for measuring the state of localized levels in such a band gap, deep-level spectroscopy, isothermal volume transient spectroscopy, photothermal polarization spectroscopy, photoacoustic spectroscopy and the constant photocurrent method are commonly used. In particular, the constant photocurrent method (abbreviated to "CPM" hereinafter) is useful as a method for simply measuring sub-gap light absorption spectra on the basis of the localized levels of a-Si:H.

The inventors have investigated the correlation between an optical band gap (abbreviated to "Eg" hereinafter) and characteristic energy (abbreviated to "Eu" hereinafter) at the exponential tail (Urbach tail) obtained from the sub-band gap light absorption spectrum measured by CPM and properties of a photosensitive member under various conditions. As a result, the inventors found that the Eg and Eu closely relate to charge performance, temperature-dependent properties and exposure memory of an amorphous silicon photosensitive member, and thus have accomplished the present invention.

Namely, it is made apparent from experiment by the inventors that a photoconductive layer, in which the optical band gap is enlarged as much as possible, and the rate of the carriers captured by the localized levels is decreased, enables a decrease in temperature-dependent properties while significantly improving charge performance, and substantial removal of the occurrence of exposure memory.

The a-Si electrophotographic light-receiving member comprises a surface layer and a charge injection blocking layer provided for blocking the injection of charge from the surface and the support in order to ensure the charge performance. However, such layers are insufficient to obtain higher charge performance, and it is necessary to increase the resistance of the photoconductive layer itself. However, the inventors found from experiment that a simple increase in the resistance causes not only problems with respect to the residual potential and exposure memory but also improvement in the charge performance which is not as good as expected. Namely, an amorphous silicon photosensitive member is generally charged by a method in which free carriers are generated by pre-charge exposure (i.e., pre-exposure), and then swept out by an electrical field during charging to create a state where the carriers are exhausted, to increase the apparent resistance. If many localized levels are present, the free carriers are not rapidly swept out, and thus the charge performance cannot be improved. Therefore, it is necessary for further improving the charge performance to increase the resistance as well as decreasing the number of localized levels.

As the cause of a decrease in charge performance which occurs when the photosensitive member is heated by a drum heater or the like, it is considered that carriers thermally excited are led by electric fields formed at the time of charging to move toward the surface while repeating their capture in and release from the localized levels of band tails and deep localized levels in a band gap, and consequently cancel surface charge. Here, the carriers having reached the surface while passing through a charger barely influence the decrease in charge performance, but the carriers having been captured in the deep levels reach the surface after they have passed through the charger,and cancel the surface charge, and hence this is observed as temperature-dependent properties. The carriers thermally excited after they have passed through the charger also cancel the surface charge to cause a decrease in charge performance. Accordingly, in order to decrease the temperature-dependent properties, it is necessary to hinder the thermally excited carriers from being produced by enlarging the optical band gap, and at the same time to improve the mobility of carriers.

The exposure memory is also caused when the photo-carriers produced by blank exposure or image exposure are captured in the localized levels in a band gap and the carriers remain in the photoconductive layer. More specifically, among photo-carriers produced in a certain copying process, the carriers having remained in the photoconductive layer are swept out by the electric field formed by surface charge at the time of subsequent charging or thereafter, and the potential at the portions exposed to light become lower than other portions, so that a density difference occurs on an image. Hence, the mobility of carriers must be improved so that they can move through the photoconductive layer at one process of copying without allowing the photo-carriers to remain in the layer.

Thus, when Eu of the photoconductive layer is controlled (decreased) while Eg is increased as in the present invention, it is possible to effectively improve the ability to hinder charge injection and hinder the production of thermally excited carriers, as well as decreasing the rate of the carriers captured in the localized levels, thereby significantly improving the mobility of the carriers. As a result, the charge performance and the temperature-dependent properties in the service environmental range of the photosensitive member can be significantly improved, and at the same time, the occurrence of exposure memory can be prevented. Hence, the stability of the photosensitive member to service environment can be improved, and high-quality images having a sharp halftone and a high resolution can be stably obtained.

Moreover, in the present invention, the intensity ratio of absorption peaks ascribable to Si—$H_2$ bonds and Si—H bonds is specified, thereby the in-plane mobility of carriers in the light-receiving member is made uniform, so that a fine density difference in a halftone image, i.e., coarseness, can be decreased.

Hence, the above-mentioned construction of the present invention can both improve the charge performance and decrease the temperature-dependent properties and exposure memory in a high degree, can solve all problems of the conventional techniques, and can form a light-receiving member having excellent electrical, optical and photoconductive properties, image quality, durability and service environmental properties.

DETAILED DESCRIPTION OF THE PREFERRED EMBODIMENT

An electrophotographic light-receiving member of the present invention is described in detail below with reference to the drawings as required.

Figure 1A:
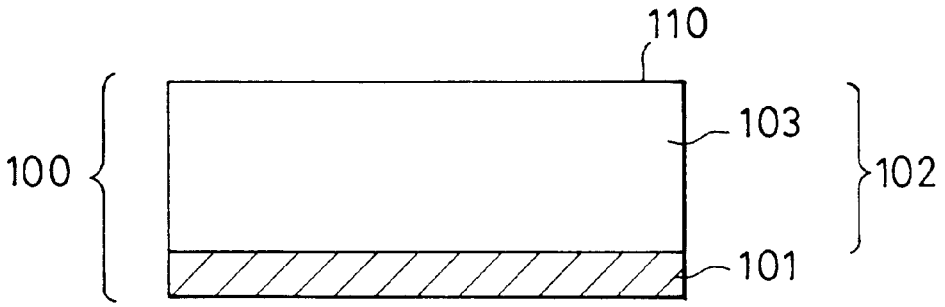
FIGS. 1(*a*) to 1(*c*) are schematic drawings illustrating examples of the layer structure of an electrophotographic light-receiving member in accordance with a preferred embodiment of the present invention.
Figure 1B:
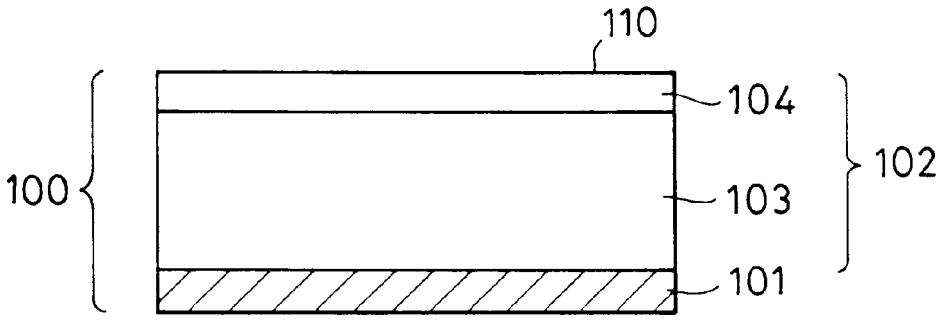
Figure 1C:
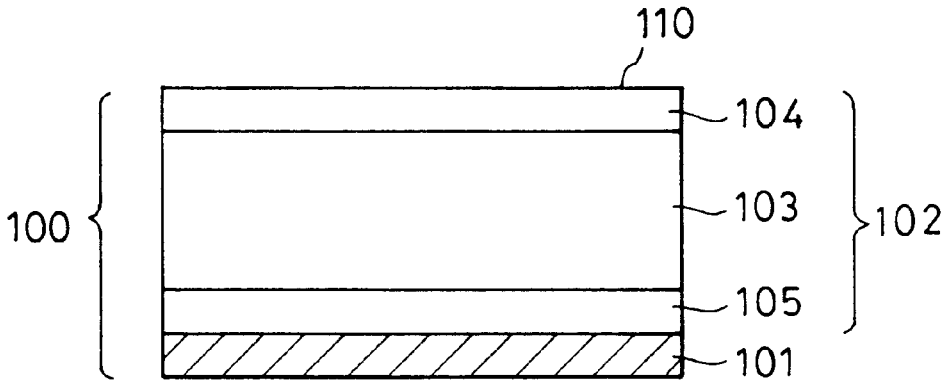
Figure 2:
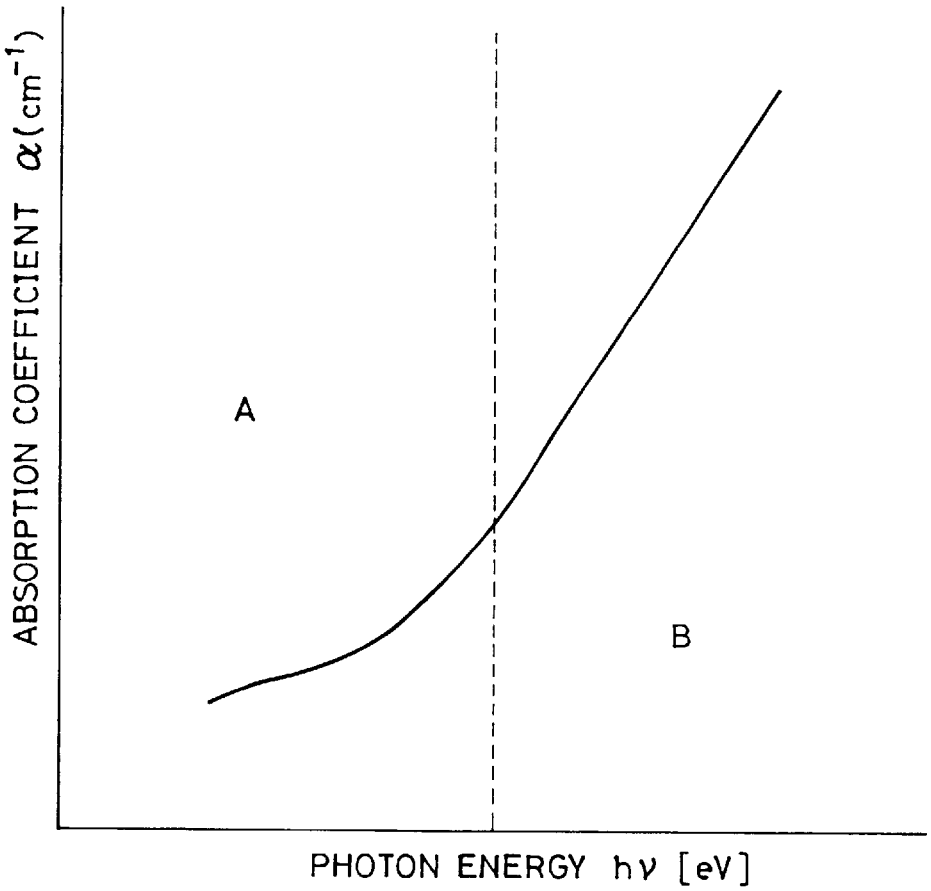
FIG. 2 is a schematic drawing illustrating an example of a sub-gap light absorption spectrum of a-Si for explaining characteristic energy at an exponential tail in accordance with the present invention.

FIGS. 1(*a*) to 1(*c*) are schematic sectional views respectively illustrating preferred examples of the layer structure of an electrophotographic light-receiving member of the present invention.

The electrophotographic light-receiving member 100 shown in FIG. 1(*a*) comprises a support 101 for the light-receiving member, and a light-receiving layer 102 provided thereon. The light-receiving layer 102 has a photoconductive layer 103 composed of a-Si:H, X.

FIG. 1(*b*) is a schematic drawing illustrating another example of the layer structure of the electrophotographic light-receiving member according to the present invention. The electrophotographic light-receiving member 100 shown in FIG. 1(*b*) comprises a support 101 for the light-receiving member, and a light-receiving layer 102 provided thereon. The light-receiving layer 102 has a photoconductive layer 103 composed of a-Si:H, X, and an amorphous silicon surface layer 104.

FIG. 1(*c*) is a schematic drawing illustrating a further example of the layer structure of the electrophotographic light-receiving member according to the present invention. The electrophotographic light-receiving member 100 shown in FIG. 1(*c*) comprises a support 101 for the light-receiving member, and a light-receiving layer 102 provided thereon. The light-receiving layer 102 has a photoconductive layer 103 composed of a-Si:H, X, an amorphous silicon surface layer 104, and an amorphous silicon charge injection blocking layer 105.

Description will now be made of each of the components of the electrophotographic light-receiving member of the present invention.

[Support]

The support 101 used in the present invention may be either conductive or electrically insulating. Examples of materials for the conductive support include metals such as Al, Cr, Mo, Au, In, Nb, Te, V, Ti, Pt, Pd, Fe, and the like; alloys thereof such as stainless and the like. The support 101 may be an electrically insulating support comprising a synthetic resin film or sheet of polyester, polyethylene, polycarbonate, cellulose acetate, polypropylene, polyvinyl chloride, polystyrene, polyamide or the like; glass or ceramic. An electrically insulating support comprising any one of these materials the surface of which is subjected to conductive treatment at least on the side on which the light-receiving layer is formed can also be used as the support.

The support 101 used in the present invention may have the shape of a cylinder with a smooth surface or uneven surface, or an endless belt. The thickness of the support 101 is appropriately determined so that the electrophotographic light-receiving member 100 can be formed as desired. In cases in which the electrophotographic light-receiving member 100 is required to have flexibility, the support 101 can be made as thin as possible so long as it can sufficiently function as a support. However, the support 101 may have a thickness of 10 $\mu$m or more in view of its manufacture and handling, mechanical strength or the like.

When images are recorded by using coherent light such as laser light, the surface of the support 101 may be made uneven so that any faulty image due to so-called interference fringes appearing in visible images can be effectively removed. The unevenness provided on the surface of the support 101 can be produced by the known methods disclosed in U.S. Pat. No. 4,650,736, U.S. Pat. No. 4,696,844 and U.S. Pat. No. 4,705,733.

As another method for effectively removing the faulty images due to interference fringes occurring when the coherent light such as laser light is used, the surface of the support 101 may be provided with unevenness by forming a plurality of spherical depression marks. Namely, the surface of the support 101 has finer unevenness than the resolving power required for the electrophotographic light-receiving member 100, and such unevenness comprise a plurality of spherical depression marks. The unevenness comprising a plurality of spherical depression marks provided on the surface of the support 101 can be formed by the known method disclosed in U.S. Pat. No. 4,735,883.

[Photoconductive Layer]

In the present invention, the photoconductive layer 103 which is formed on the support 101 in order to effectively achieve the objects of the present invention and which constitutes part of the light-receiving layer 102 is produced by a vacuum deposited film forming method under numerical conditions of film formation parameters which are appropriately set so as to achieve desired characteristics. Specifically, the photoconductive layer 103 can be formed by various thin-film deposition processes such as glow discharge including AC discharge CVD such as low-frequency CVD, high-frequency CVD or microwave CVD, and DC discharge CVD; sputtering; vacuum deposition; ion plating; optical CVD; thermal CVD; etc. One of these thin-film deposition processes is appropriately selected in accordance with factors such as manufacturing conditions, the degree of a load on capital investment in equipment, the manufacturing scale and properties desired on the electrophotographic light-receiving member produced. However, glow discharge, particularly RF band or VHF band high-frequency glow discharge, is preferred in view of its relative easiness of control of conditions in manufacture of the electrophotographic light-receiving member having desired characteristics.

When the photoconductive layer 103 is formed by the glow discharge process, basically a. Si supply material gas capable of supplying silicon atoms (Si), a H supply material gas capable of supplying hydrogen atoms (H) and/or an X supply material gas capable of supplying halogen atoms (X) are introduced in the desired gaseous state into a reactor the inside of which can be evacuated, and glow discharge is created in the reactor to form a layer comprising a-Si:H, X on the predetermined support 101 previously set at a predetermined position.

In the present invention, the photoconductive layer 103 is required to contain hydrogen atoms and/or halogen atoms. This is essential and indispensable for compensating unbonded arms of silicon atoms and improving layer quality, particularly, photoconductivity and charge retentivity. Therefore, the content of the hydrogen atoms or the halogen atoms, or the total amount of the hydrogen atoms and the halogen atoms is preferably 25 to 40 atomic %, more preferably 30 to 35 atomic %, of the total amount of the silicon atoms and the hydrogen atoms and/or the halogen atoms.

Examples of materials that can effectively be used as the Si supply gas in the present invention include gaseous or gasifiable silicon halides (silanes) such as $SiH_4$, $Si_2H_6$, $Si_3H_8$, $Si_4H_{10}$, and the like. From the viewpoints of ease of handling in layer formation, and efficiency of Si supply, $SiH_4$ and $Si_2H_6$ are preferred.

In order to structurally introduce the hydrogen atoms into the photoconductive layer 103 to be formed, and to facilitate the control of the ratio of the hydrogen atoms introduced to obtain film characteristics for achieving the objects of the present invention, the layer must be formed in an atmosphere in which these gases are further mixed with a desired amount of gas of $H_2$ and/or He or a silicon compound containing hydrogen atoms. Each of the gases may be mixed either singly or in combination of plural species in a desired mixing ratio, without any problems.

Preferable examples of the raw material gas for effectively supplying halogen atoms used in the present invention include gaseous or gasifiable halogen compounds such as halogen gases, halides, halogen-containing interhalogen compounds, halogen-substituted silane derivatives, and the like. Effective examples further include gaseous or gasifiable halogen-containing silicon halide compounds comprising silicon atoms and halogen atoms as components. Examples of halogen compounds which can preferably used in the present invention include fluorine gas ($F_2$), and interhalogen compounds such as BrF, ClF, $ClF_3$, $BrF_3$, $BrF_5$, $IF_3$, $IF_7$, and the like. Preferred examples of halogen-containing silicon compounds, i.e., halogen-substituted silane derivatives, include silicon fluorides such as $SiF_4$, $Si_2F_3$, and the like.

In order to control the amount of the hydrogen atoms and/or the halogen atoms contained in the photoconductive layer 103, for example, the temperature of the support 101, the amount of the raw materials introduced into the reactor for mixing the hydrogen atoms and/or the halogen atoms, discharge power and so forth may be controlled.

In the present invention, the photoconductive layer 103 preferably contains atoms capable of controlling the conductivity as occasion demands. The atoms may be contained in the photoconductive layer 103 in a uniform distribution state, or may be contained partly in a nonuniform distribution state in the direction of the thickness of the layer.

The atoms capable of controlling the conductivity include so-called impurities used in the field of semiconductors, such as atoms belonging to Group IIIb (Group 13) of the Periodic Table (hereinafter, abbreviated to "Group IIIb atoms"), which can impart p-type conductivity, and atoms belonging to Group Vb (Group 15) of the Periodic Table (hereinafter, abbreviated to "Group Vb atoms") which can impart n-type conductivity.

Examples of the Group IIIb atoms include boron (B), aluminum (Al), gallium (Ga), indium (In), and thallium (Tl). In particular, B, Al and Ga are preferred. Examples of the Group Vb atoms include phosphorus (P), arsenic (As), antimony (Sb), and bismuth (Bi). In particular, P and As are preferred.

The content of the atoms contained in the photoconductive layer 103 in order to control its conductivity is preferably $1\times10^{-2}$ to $1\times10^{2}$ atomic ppm, more preferably $5\times10^{-2}$ to 50 atomic ppm, and most preferably $1\times10^{-1}$ to 10 atomic ppm.

In order to structurally introduce the atoms for controlling the conductivity, e.g., the Group IIIb atoms or the Group Vb atoms, a gaseous raw material for introducing Group IIIb atoms or Group Vb atoms may be introduced into the reactor together with other gases for forming the photoconductive layer 103 during the formation of the layer. As the raw material for introducing the Group IIIb atoms or the Group Vb atoms, materials which are gaseous at room temperature and normal pressure or materials which can easily be gasified at least under conditions for forming the photoconductive layer are preferably used.

Examples of such raw materials for introducing the Group IIIb atoms include boron hydrides such as $B_2H_6$, $B_4H_{10}$, $B_5H_9$, $B_5H_{11}$, $B_6H_{10}$, $B_6H_{12}$, $B_6H_{14}$, and the like; boron halides such as $BF_3$, $BCl_3$, $BBr_3$, and the like; which are used for introducing boron atomic. Other examples include $AlCl_3$, $GaCl_3$, $Ga(CH_3)_3$, $InCl_3$, $TlCl_3$, and the like.

Examples of raw materials which can be effectively used for introducing the Group Vb atoms include phosphorus hydrides such as $PH_3$, $P_2H_4$, and the like; phosphorus halides $PH_4I$, $PF_3$, $PF_5$, $PCl_3$, $PCl_5$, $PBr_3$, $PBr_5$, $PI_3$, and the like; which are used for introducing phosphorus atoms. Other effective examples of the raw materials for introducing the Group Vb atoms $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$, and the like.

These raw materials for introducing the atoms for controlling the conductivity may be diluted with a gas such as $H_2$ and/or He as occasion demands.

In the present invention, it is also effective to provide at least one kind of atoms selected from the group consisting of carbon atoms, oxygen atoms and nitrogen atoms in the photoconductive layer 103. The content of the atoms selected from the group consisting of carbon atoms, oxygen atoms and nitrogen atoms is preferably $1\times10^{-4}$ to 10 atomic %, more preferably $1\times10^{-3}$ to 5 atomic %, and more preferably $1\times10^{-2}$ to 1 atomic %, relative to the total amount of the silicon atoms, carbon atoms, oxygen atoms and nitrogen atoms. The atoms selected from the group consisting of carbon atoms, oxygen atoms and nitrogen atoms may be uniformly distributed in the photoconductive layer 103, or may be partly nonuniformly distributed so that the content thereof changes in the direction of the thickness of the photoconductive layer.

In the present invention, the thickness of the photoconductive layer 103 is appropriately determined from the viewpoints of desired electrophotographic properties and economical effects. The thickness is preferably 20 to 50 $\mu$m, more preferably 23 to 45 $\mu$m, and most preferably 25 to 40 $\mu$m. This is determined by considering that with a layer thickness of less than 20 $\mu$m, electrophotographic properties such as charge performance and sensitivity become unsatisfactory for practical use, while with a layer thickness of over 50 $\mu$m, a long time is required for forming the photoconductive layer, resulting in an increase in production cost.

In order to achieve the objects of the present invention and to form the photoconductive layer 103 having desired film characteristics, it is necessary to appropriately set the flow rate of the Si supply gas, the mixing ratio of Si supply gas and dilute gas, the gas pressure in the reactor, discharge power and the support temperature.

Although the flow rate of the Si supply gas is appropriately selected within an optimum range in accordance with the design of the layer, the ratio (X/Z) of the flow rate (X) of the Si supply gas to the discharge space volume (Z) is preferably $1\times10^{-3}$ to $1\times10^{-2}$ sccm/cm$^3$, and more preferably $3\times10^{-3}$ to $5\times10^{-2}$ sccm/cm$^3$.

Although the flow rate of $H_2$ and/or He used as a dilution gas is also appropriately selected within an optimum range in accordance with the design of the layer, $H_2$ and/or He is preferably controlled within the range of 5 to 30 times, more preferably 8 to 25 times, and most preferably 10 to 20 times, based on the Si supply gas.

The gas pressure in the reactor is also appropriately selected within an optimum range in accordance with the design of the layer, but the pressure is preferably $3\times10^{-2}$ to $1.3\times10^{3}$ Pa, more preferably $6.7\times10^{-2}$ to $6.7\times10^{2}$ Pa, and $1.3\times10^{-1}$ to $1.3\times10^{2}$ Pa.

Similarly, although the discharge power is also appropriately selected within an optimum range in accordance with the deign of the layer, the ratio (Y/X) of the power density (Y) input to the discharge space to the flow rate (X) of the Si supply gas is preferably set within the range of $3\times10^{-4}$ to $7\times10^{-4}$ W/cm$^3$·sccm, and most preferably $4\times10^{-4}$ to $6\times10^{-4}$ W/cm$^3$·sccm.

Although the temperature of the support 101 is appropriately selected within an optimum range in accordance with the design of the layer, the temperature is preferably 200 to 350° C., more preferably 230 to 330° C., and most preferably 250 to 300° C.

In the present invention, preferable values of the support temperature and gas pressure for forming the photoconductive layer are within the above-described ranges. However, these conditions cannot be independently separately determined, and optimum values should be determined on the basis of mutual and systematic relationship so that the light-receiving member having the desired characteristics can be formed.

[Surface Layer]

In the present invention, the amorphous silicon surface layer 104 is preferably further formed on the photoconductive layer 103 formed on the support 101 in the above-described manner. This surface layer 104 has a free surface 110, and is provided for achieving the objects of the present invention with respect to moisture resistance, properties of continuous repeated use, electrical voltage resistance, service environmental properties and durability.

In the present invention, since the amorphous materials of the photoconductive layer and the surface layer 104 which constitute the light-receiving layer 102 contain a common component, silicon atoms, chemical stability is sufficiently ensured at the interface between the layers.

The surface layer 104 may be formed using any materials so long as they are amorphous silicon type materials. Preferable examples of such materials include amorphous silicon (referred to as "a-SiC:H, X" hereinafter) containing hydrogen atoms (H) and/or halogen atoms (X) and further carbon atoms, amorphous silicon (referred to as "a-SiO:H, X" hereinafter) containing hydrogen atoms (H) and/or halogen atoms (X) and further oxygen atoms, amorphous silicon (referred to as "a-SiN:H, X" hereinafter) containing hydrogen atoms (H) and/or halogen atoms (X) and further nitrogen atoms, and amorphous silicon (referred to as "a-SiCON:H, X", hereinafter) containing hydrogen atoms (H) and/or halogen atoms (X) and further at least one kind of atoms selected from the group consisting of carbon atoms, oxygen atoms and nitrogen atoms.

In the present invention, in order to effectively achieve the objects thereof, the surface layer 104 is prepared by a vacuum deposited film forming process under numerical conditions of film formation parameters appropriately set so as to obtain the desired characteristics. Specifically, the surface layer 104 can be formed by various thin film deposition processes such as glow discharge including AC discharge CVD such as low-frequency CVD, high-frequency CVD and microwave CVD, and DC discharge CVD; sputtering; vacuum deposition; ion plating; optical CVD; thermal CVD; and so forth. Suitable process is appropriately selected from these thin film deposition processes in accordance with factors such as manufacture conditions, the degree of a load on capital investment in equipment, the manufacture scale, and properties desired on the electrophotographic light-receiving member produced. However, it is preferable from the viewpoint of productivity of the light-receiving member to use the same deposition method as the photoconductive layer.

For example, when the surface layer 104 comprising a-SiC:H, X is formed by the glow discharge process, basically, an Si supply raw material gas capable of supplying silicon atoms (Si), a C supply raw material gas capable of supplying carbon atoms (C), an H supply raw material gas capable of supplying hydrogen atoms (H) and/or an X supply raw material gas capable of supplying halogen atoms (X) are introduced in the desired gaseous state into the reactor the inside of which can be evacuated, and glow discharge is created in the reactor to form the a-SiC:H, X layer on the substrate 101 which was previously set at the predetermined position and on which the photoconductive layer 103 is formed.

As materials for the surface layer used in the present invention, any silicon-containing amorphous materials may be used. Compounds with silicon atoms which contain at last one element selected from carbon nitrogen and oxygen are preferred, and compounds containing a-SiC as a main component are particularly preferable.

When the surface layer comprises a-SiC as a main component, the carbon content is preferably within the range of 30 to 90% of the total amount of silicon atoms and carbon atoms.

In the present invention, the surface layer 104 should contain hydrogen atoms and/or halogen atoms. This is essential and indispensable for compensating unbonded electrons of silicon atoms, and improving the layer quality, particularly, improving the photoconductivity and charge retentivity. The hydrogen content is preferably 30 to 70 atomic %, more preferably 35 to 65 atomic %, and most preferably 40 to 60 atomic %, of the total amount of constituent atoms. The content of fluorine atoms is preferably 0.01 to 15 atomic %, more preferably 0.1 to 10 atomic %, and most preferably 0.6 to 4 atomic %.

The light-receiving member formed so as to have a hydrogen and/or fluorine content within the above ranges can be sufficiently put into practical use as an extremely excellent member hitherto unavailable. Specifically, defects (mainly comprising dangling bonds of silicon atoms and carbon atoms) present in the surface layer are known to have adverse effects on the properties as the electrophotographic light-receiving member. Examples of such adverse effects include deterioration in the charge performance due to the charge injection from the free surface, changes in the charge performance due to changes in the surface structure in a service environment, e.g., a high humidity, the occurrence of afterimage during repeated use due to the entrapment of charge in the defects in the surface layer when charge is injected into the surface layer from the photoconductive layer at the time of corona charging or light irradiation.

However, the control of the hydrogen content of the surface layer to 30 atomic % or more significantly decreases the defects in the surface layer, and consequently significantly improves the electrical characteristics and high-speed continuous use properties compared with conventional members.

On the other hand, if the hydrogen content of the surface layer is 71 atomic % or more, the hardness of the surface layer is decreased, and hence the layer cannot resist repeated use in some cases. Thus, the control of the hydrogen content of the surface layer within the above range is one of very important factors for obtaining very excellent electrophotographic characteristics as desired. The hydrogen content of the surface layer can be controlled by controlling the flow rates (ratio) of raw material gases, the support temperature, discharge power, gas pressure and so forth.

The control of the fluorine content of the surface layer within the range of 0.01 atomic % or more also makes it possible to effectively generate bonds of silicon and carbon atoms within the surface layer. The fluorine atoms contained in the surface layer also function to effectively prevent the bonds between silicon and carbon atoms from being cut due to damage caused by corona or the like.

On the other hand, if the fluorine content of the surface layer exceeds 15 atomic %, there are substantially no effect of generating the bonds between silicon and carbon atoms in the surface layer and no effect of preventing cutting of the bonds between silicon and carbon atoms due to damage caused by corona. Moreover, since the excessive fluorine atoms inhibit the mobility of carriers in the surface layer, residual potential and image memory are significantly observed. Thus, the control of the fluorine content of the surface layer within the above range is one of very important factors for obtaining desired electrophotographic characteristics. The fluorine content of the surface layer can be controlled by controlling the flow rates (ratios) of raw material gases, the support temperature, discharge power, gas pressure and so forth in the same manner as the hydrogen content.

Examples of materials for the silicon (Si) supply gas used for forming the surface layer in the present invention include gaseous or gasifiable silicon hydrides (silanes) such as $SiH_4$, $Si_2H_6$, $Si_3H_8$, $Si_4H_{10}$, and the like. $SiH_4$ and $Si_2H_6$ are preferably used from the viewpoints of ease of handling in layer formation and efficiency of Si supply. These Si supply raw material gases may be diluted with a gas such as $H_2$, He, Ar, Ne or the like according to demand.

Examples of materials for the carbon supply gas include gaseous or gasifiable hydrocarbons such as $CH_4$, $C_2H_2$, $C_2H_6$, $C_3H_8$, $C_4H_{10}$, and the like. $CH_4$, $C_2H_2$ and $C_2H_6$ are preferably used from the viewpoints of ease of handling in layer formation and efficiency of C supply. These C supply raw material gases may be diluted with a gas such as $H_2$, He, Ar, Ne or the like according to demand.

Examples of materials for the nitrogen or oxygen supply gas include gaseous or gasifiable compounds such as $NH_3$, NO, $N_2O$, $NO_2$, $O_2$, CO, $CO_2$, $N_2$, and the like. These nitrogen or oxygen supply raw material gases may be diluted with a gas such as $H_2$, He, Ar, Ne or the like according to demand.

In order to facilitate the control of the ratio of the hydrogen atoms introduced into the surface layer 104 to be formed, it is preferable to form the layer in an atmosphere in which these gases are further mixed with a desired amount of hydrogen gas or silicon compound gas containing hydrogen atoms. These gases may be used either singly or in combination of plural gases in a desired mixing ratio, without any problem.

Preferable examples of the raw material gas for effectively supplying halogen atoms include halogen gas, gaseous or gasifiable halogen compounds such as halides, halogen-containing interhalogen compounds, halogen-substituted silane derivatives, and the like. Examples further include gaseous or gasifiable halogen-containing silicon hydride compounds containing silicon and halogen atoms as constituent elements. Examples of halogen compounds that can preferably used in the present invention include fluorine gas ($F_2$), and interhalogen compounds such as BrF, ClF, $ClF_3$, $BrF_3$, $BrF_5$, $IF_3$, $IF_7$, and the like. Preferable examples of halogen-containing silicon compounds, i.e., halogen-substituted silane derivatives, include silicon fluorides such as $SiF_4$, $Si_2F_3$ and the like.

In order to control the amount of the hydrogen atoms and/or halogen atoms contained in the surface layer 104, for example, the temperature of the support 101, the amount of the raw material introduced into the reactor for mixing the hydrogen atoms and/or halogen atoms, the discharge power and so forth may be controlled.

The atoms selected from the group consisting of carbon atoms, oxygen atoms and nitrogen atoms may uniformly distributed in the surface layer, or may be partly non-uniformly distributed so that its content changes in the direction of the thickness of the surface layer.

In the present invention, the surface layer 104 preferably further contains atoms for controlling the conductivity as occasion demands. The atoms for controlling the conductivity may be contained so as to be uniformly distributed in the surface layer, or may be partly non-uniformly distributed so that the content thereof changes in the direction of the thickness of the surface layer.

Examples of such atoms for controlling the conductivity includes so-called impurities used in the field of semiconductors, as described above in regard to the photoconductive layer.

The content of the atoms contained in the surface layer 104 for controlling the conductivity thereof is preferably $1\times10^{-3}$ to $1\times10^{3}$ atomic ppm, more preferably $1\times10^{-2}$ to $5\times10^{2}$ atomic ppm, and most preferably $1\times10^{-1}$ to $1\times10^{2}$ atomic ppm. In order to structurally introduce the atoms for controlling the conductivity, for example, the Group IIIb atoms or the Group Vb atoms, the raw material for introducing the Group IIIb atoms or the raw material for introducing the Group Vb atoms may be introduced in a gaseous state into the reactor during the layer formation together with other gases for forming the surface layer 104. The raw material for introducing the Group IIIb atoms or the raw material for introducing the Group Vb atoms can be appropriately selected from the materials described above in regard to the photoconductive layer.

The raw material for introducing the atoms for controlling the conductivity may be diluted with a gas such as $H_2$, He, Ar, Ne or the like as occasion demands, as described above.

The surface layer 104 in accordance with the present invention is preferably formed in a thickness of 0.01 to 3 $\mu$m, more preferably 0.05 to 2 $\mu$m, and most preferably 0.1 to 1 $\mu$m. If the layer thickness is less than 0.01 $\mu$m, the surface layer is lost due to friction or the like during the use of the light-receiving member. If the thickness exceeds 3 $\mu$m, deterioration in electrophotographic characteristics such as an increase in residual potential occurs.

The surface layer 104 according to the present invention is carefully formed so that the required characteristics can be obtained as desired. Namely, the material comprising atoms of the element selected from Si (silicon), C (carbon), N (nitrogen) and O (oxygen), and H and/or X as constituent elements has a structural form varying from crystal to amorphous depending upon the formation conditions, and exhibits electric properties varying from conductive to semiconductive and insulating properties, and also properties varying from photoconductive to non-photoconductive. Accordingly, in the present invention, the formation conditions for the material are severely selected as desired so that a compound having the desired properties for the purpose can be obtained.

For example, in order to provide the surface layer 104 mainly for the purpose of improving the voltage resistance, it is preferable to produce a non-single crystal material having remarkable electrical insulating behavior in the service environment.

When the surface layer 104 is provided mainly for the purpose of improving the properties of continuous repeated use and service environmental properties, it is preferably to form a non-single crystal material having the electrical insulating properties lowered to some extent, and a certain degree of sensitivity to the light applied thereto.

In order to form the surface layer 104 having properties that enable achievement of the objects of the present invention, the temperature of the support 101 and the gas pressure in the reactor must be appropriately set according to demand.

The temperature (Ts) of the support 101 is selected within an optimum range according to the design of the layer. In usual cases, the temperature is preferably 200 to 350° C., more preferably 230 to 330° C., and most preferably 250 to 310° C.

Similarly, the gas pressure in the reactor is selected within an optimum range according to the design of the layer. In usual cases, the gas pressure is preferably $3\times10^{-2}$ to $1.3\times10^{3}$ Pa, more preferably $6.7\times10^{-2}$ to $6.7\times10^{2}$ Pa, and most preferably 1.3×10−1 to $1.3\times10^{2}$ Pa.

In the present invention, although preferable values of the support temperature and the gas pressure for forming the surface layer are within the above ranges, these conditions cannot be independently separately determined, and optimum values are preferably determined based on mutual and systematic relationship so that the light-receiving member having the desired characteristics can be formed.

In the present invention, it is also effective for further improving the characteristics such as the charge performance to provide, between the photoconductive layer and the surface layer, a blocking layer (lower surface layer) having a lower content of atoms selected from the group consisting of carbon atoms, oxygen atoms and nitrogen atoms than the surface layer.

Between the surface layer 104 and the photoconductive layer 103, a region may be provided in which the content of atoms selected from the group consisting of carbon atoms, oxygen atoms and nitrogen atoms changes so as to decrease toward the photoconductive layer 103. This can improve the adhesion between the surface layer and the photoconductive layer, and decrease the influence of interference due to the light reflected by the interface between the layers.

[Charge Injection Blocking Layer]

In the electrophotographic light-receiving member of the present invention, it is more effective to provide between the conductive support and the photoconductive layer a charge injection blocking layer having the function to block the injection of charge from the conductive support side. Namely, the charge injection blocking layer has the function to block the injection of charge from the support side to the photoconductive layer side when the free surface of the light-receiving layer is subjected to charging with a certain polarity, and exhibits no such function when subjected to charging with a reverse polarity. In other words, the charge injection blocking layer has polarity dependence. In order to impart such function, atoms for controlling the conductivity are contained in the charge injection blocking layer in a relatively large amount compared with the photoconductive layer.

The atoms for controlling the conductivity, contained in the charge injection blocking layer, may be uniformly distributed in the layer, or may be uniformly distributed in the direction of the thickness thereof but partly contained to be non-uniformly distributed. In the case when the concentration of the atoms is distributed non-uniformly, the atoms is preferably distributed so as to be distributed in a larger amount on the support side.

In any case, however, in order to make uniform the properties in the in-plane direction parallel to the surface of the support, it is necessary for such atoms to be evenly contained in a uniform distribution in the in-plane direction.

Examples of the atoms contained in the charge injection blocking layer, for controlling the conductivity, include the above-described impurities.

Although the content of the atoms contained in the charge injection blocking layer, for controlling the conductivity, is appropriately determined as desired so that the objects of the present invention can effectively be achieved, the content is preferably 10 to $1\times10^{4}$ atomic ppm, more preferably 50 to $5\times10^{3}$ atomic ppm, and most preferably $1\times10^{2}$ to $3\times10^{3}$ atomic ppm.

The charge injection blocking layer may further contain at least one kind of atoms selected carbon atoms, nitrogen atoms and oxygen atoms so that the adhesion between the charge injection blocking layer and other layer provided in direct contact therewith can further be improved.

The at least one kind of atoms selected from the group consisting of carbon atoms, nitrogen atoms and oxygen atoms, contained in the charge injection blocking layer, may be uniformly distributed in the layer, or may be evenly contained in the direction of the thickness thereof but partly contained so as to be distributed non-uniformly. In any case, however, in order to make uniform the properties in the in-plane direction parallel to the surface of the support, it is necessary for such atoms to be evenly contained in a uniform distribution in the in-plane direction.

Although the content of the at least one kind of atoms selected from the group consisting of carbon atoms, nitrogen atoms and oxygen atoms, contained in the entire region of the charge injection blocking layer is appropriately determined so that the objects of the present invention can effectively be achieved, the content as the amount of one kind of atoms or as the total amount of two or more kinds of atoms is preferably $1\times10^{-3}$ to 50 atomic %, more preferably $5\times10^{-3}$ to 30 atomic %, and most preferably $1\times10^{-2}$ to 10 atomic %.

The hydrogen atoms and/or halogen atoms contained in the charge injection blocking layer have the effect of compensating unbonded electrons present in the layer to improve film quality. The content of hydrogen atoms or halogen atoms or the total amount of hydrogen atoms and halogen atoms is preferably 1 to 50 atomic %, more preferably 5 to 40 atomic %, and most preferably 10 to 30 atomic %.

In the present invention, from the viewpoints of achievement of the desired electrophotographic properties and of economical effects, the thickness of the charge injection blocking layer is preferably 0.1 to 5 $\mu$M, more preferably 0.3 to 4 $\mu$m, and most preferably 0.5 to 3 $\mu$m, With a layer thickness of less than 0.1 $\mu$m, the ability to inhibit the injection of charge from the support becomes insufficient, thereby obtaining insufficient charge performance. Even with a thickness of over 5 $\mu$m, the electrophotographic properties are not improved, and an increase in the time required for forming the layer causes an increase in production cost.

In the present invention, the charge injection blocking layer is formed by employing the same vacuum deposition process as that for forming the photoconductive layer.

In order to form the charge injection blocking layer 105 having properties which enable the achievement of the objects of the present invention, it is necessary to appropriately set the mixing ratio of the Si supply gas and dilution gas, the gas pressure in the reactor, discharge power and the temperature of the support 101 in the same manner as the photoconductive layer 103.

Although the flow rate of $H_2$ and/or He as the dilution gas is appropriately selected within an optimum range in accordance with the design of the layer, the flow rate of $H_2$ and/or He is preferably controlled within the range of 1 to 20 times, more preferably 3 to 15 times, and most preferably 5 to 10 times, based on the Si supply gas.

Similarly, although the gas pressure in the reactor is appropriately selected within an optimum range in accordance with the design of the layer, the pressure is preferably $1.3\times10^{-2}$ to $1.3\times10^{3}$ Pa, more preferably $6.7\times10^{-2}$ to $6.7\times10^{2}$ Pa, and most preferably $1.3\times10^{-1}$ to $1.3\times10^{2}$ Pa.

Similarly, although the discharge power is also appropriately selected within an optimum range in accordance with the design of the layer, the ratio (Y/X) of the power density (Y) input to the discharge space to the flow rate (X) of the Si supply gas is preferably set within the range of $3\times10^{-5}$ to $4\times10^{-4}$ W/cm$^3$·sccm, more preferably $6\times10^{-5}$ to $3\times10^{-4}$ W/cm$^3$·sccm, and most preferably $1\times10^{-4}$ to $3\times10^{-4}$ W/cm$^3$·sccm.

Further, although the temperature of the support 101 is appropriately selected within an optimum range in accordance with the design of the layer, the temperature is preferably 200 to 350° C., more preferably 230 to 330° C., and most preferably 250 to 310° C.

In the present invention, although the preferable values of the mixing ratio of the dilution gas, gas pressure, discharge power and support temperature for forming the charge injection blocking layer are determined within the above ranges, these factors for forming the layer cannot be independently separately determined. Optimum values of the factors should be determined on the basis of mutual and systematic relationships so as to form the surface layer having the desired properties.

In addition, the electrophotographic light-receiving member of the present invention preferably has a layer region provided on the support side of the light-receiving layer 102 and containing at least aluminum atoms, silicon atoms, hydrogen atoms and/or halogen atoms in a uniform distribution in the direction of the thickness thereof.

The electrophotographic light-receiving member of the present invention may further comprise an adhesive layer provided for further improving the adhesion between the support 101 and the photoconductive layer 103 or te charge injection blocking layer 105 and comprising, for example, $Si_3N_4$, $SiO_2$, SiO or an amorphous material containing silicon atoms as a main component and atoms selected from the group consisting of carbon atoms, oxygen atoms and nitrogen atoms. A light-absorbing layer may also be provided for preventing the occurrence of interference fringes due to the light reflected from the support.

The apparatus and film forming method for forming the light-receiving layer will be described in detail below.

Figure 3:
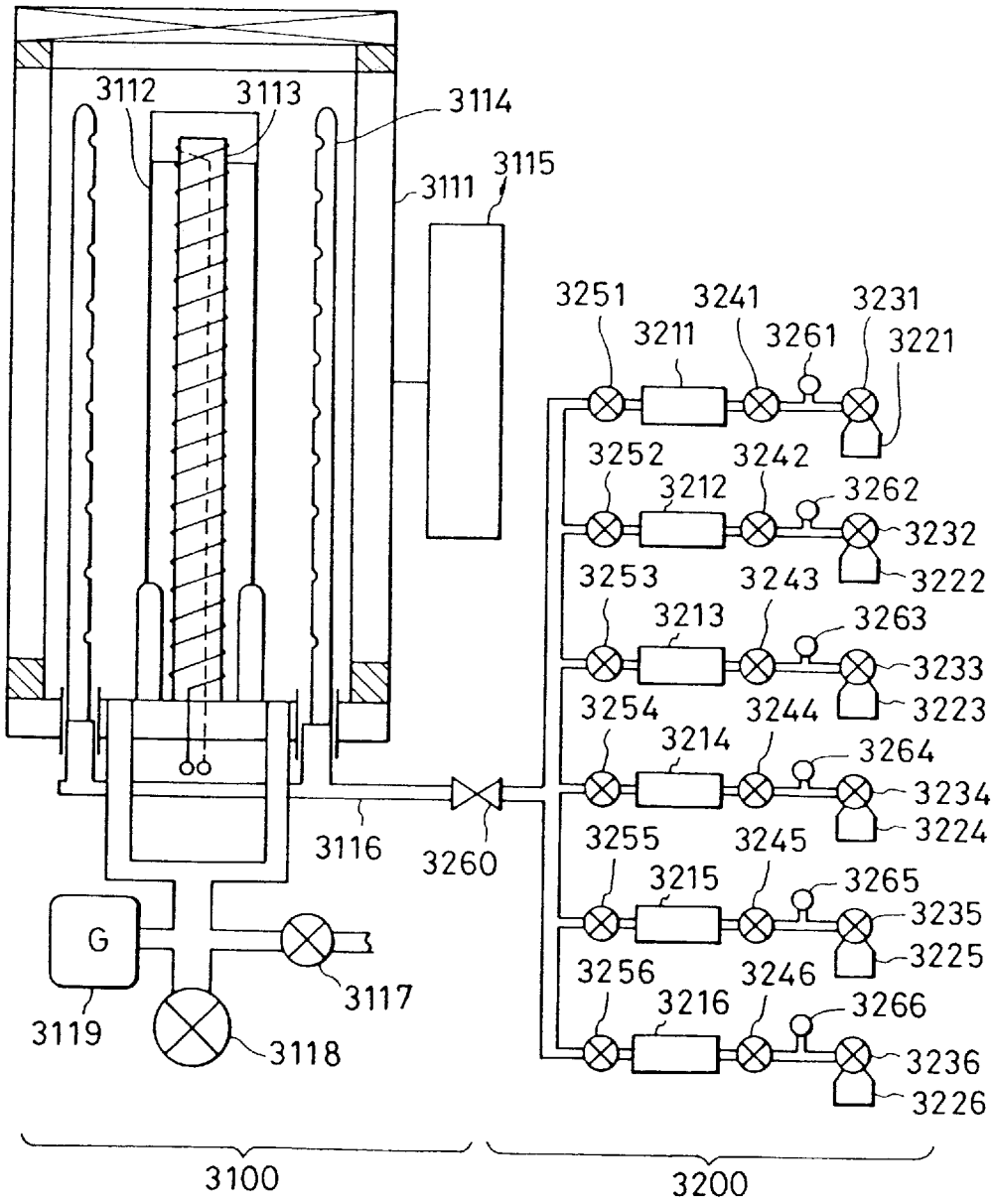
FIG. 3 is a schematic drawing illustrating an apparatus for producing an electrophotographic light-receiving member by a glow discharge process using RF band high frequencies as an example of an apparatus for forming a light-receiving layer of an electrophotographic light-receiving member of the present invention.

FIG. 3 is a schematic block diagram illustrating an example of an apparatus for producing the electrophotographic light-receiving member by high-frequency plasma CVD using RF band frequencies (abbreviated to "RF-PCVD" hereinafter). The construction of the apparatus shown in FIG. 3 as follows.

This apparatus mainly comprises a deposition device 3100, a raw material supply device 3200, and an exhaust device (not shown) for evacuating the inside of a reactor 3111. In the reactor in the deposition device 3100, are provided a cylindrical support 3112, a support heater 3113 and a raw material gas inlet pipe 3114. A high-frequency matching box 3115 is also connected to the reactor 3111.

The raw material gas supply device 3200 has gas cylinders 3221 to 3226 for raw material gases such as $SiH_4$, $GeH_4$, $H_2$, $CH_4$, $B_2H_6$, $PH_3$, and the like; valves 3231 to 3236, 3241 to 3246 and 3251 to 3256; and mass flow controllers 3211 to 3216. The gas cylinders for the respective raw material gases are connected to the gas inlet pipe 3114 in the reactor 3111 through a valve 3260.

Deposited films can be formed by using the apparatus, for example, in the following manner.

The cylindrical substrate 3112 is first set in the reactor 3111, and the inside of the reactor 3111 is then evacuated by the exhaust device (not shown), for example, a vacuum pump. The temperature of the substrate 3112 is then controlled at a predetermined temperature of 200 to 350° C. by means of the support heater 3113.

Before raw material gases for forming deposited films are flowed into the reactor, the valves 3231 to 3236 of the gas cylinders and the leak valve 3117 of the reactor are checked to make sure that they are closed, and also the flow-in valves 3241 to 3246, the flow-out valves 3251 to 3256 and an auxiliary valve 3260 are checked to make sure that they are open. Then, a main valve 3118 is first opened to evacuate the insides of the reactor 3111 and a gas pipe 3116.

Next, at the time a vacuum gauge 3119 indicates about $6.67\times10^{-4}$ Pa ($5\times10^{-4}$ Torr), the auxiliary valve 3260 and the flow-out valves 3251 to 3256 are closed.

Thereafter, the valves 3231 to 3236 are opened to respectively introduce the gases from the gas cylinders 3221 to 3226, and the pressures of the gases are respectively controlled to 2 $Kg/cm^2$ by pressure controllers 3261 to 3266. Next, the flow-in valves 3241 to 3246 are gradually opened to introduce the gases into the mass flow controllers 3211 to 3216, respectively.

After preparation for film formation is completely made, each of the layers is formed according to the following procedure.

At the time the cylindrical support 3112 is heated to a predetermined temperature, necessary valves of the flow-out valves 3251 to 3256 and the auxiliary valve 3260 are gradually opened to introduce predetermined gases into the reactor 3111 from the gas cylinders 3221 to 3226 through the gas inlet pipe 3114. Next, the raw material gases are respectively controlled to predetermined flow rates by the mass flow controllers 3211 to 3216. At the same time, the opening of the main valve 3118 is controlled so that the pressure in the reactor 3111 is a predetermined value of 1 Torr or less, while watching the vacuum gauge 3119. At the time the inner pressure becomes stable, the RF power source (not shown) with a frequency of 13.56 MHz is set to a desired electric power, and the RF power is introduced into the reactor 3111 through the high-frequency matching box 3115 to cause glow discharge. The raw material gases introduced into the reactor are decomposed by the discharge energy to form a deposited film comprising predetermined silicon as a main component on the cylindrical support 3112. After the film having the desired thickness is formed, the supply of the RF power is stopped, and the flow-out valves are closed to stop the gases from flowing into the reactor. The formation of the deposited film is thus completed.

The same operation is repeated plural times to form the light-receiving layer having the desired multilayer structure.

When each of the layers is formed, the flow-out valves other than those for necessary gases are closed. Also, in order to prevent the gases from remaining in the reactor 3111 and in the pipe extending from the flow-out valves 3251 to 3256 to the reactor 3111, the flow-out valves 3251 to 3256 are closed, the auxiliary valve 3260 is opened, and the main valve 3118 is full-opened, to evacuate the inside of the system to a high degree of vacuum as occasion demands.

In order to form a uniform film, it is effective to rotate the support 3112 at a given speed by a driving device (not shown) during the formation of the film.

The gas species and the valve operations, of course, can be changed according to the conditions for forming each of the layers.

In the formation of deposited films, the support temperature is, particularly, 200 to 350° C., preferably 230 to 330° C., and more preferably 250 to 310° C.

The support may be heated by any heating element so long as it is a vacuum type, for example, electric resistance heating elements such as a sheathed-heater winding heater, a plate heater, a ceramic heater, and the like; heat radiation lamp heating elements such as a halogen lamp, an infrared lamp, and the like; and heating elements employing heat-exchange means using a liquid, a gas or the like as a hot medium. As surface materials of the heating means, metals such as stainless steel, nickel, aluminum, copper, and the like; ceramics; heat-resistant polymer resins and the like can be used.

Another heating method that can be used is a method in which a container exclusively used for heating is provided in addition to the reactor, and the support is heated therein, and then transported into the reactor under vacuum.

EXPERIMENTAL EXAMPLES

The effects of the present invention will be described in detail with reference to experimental examples.

Experimental Example 1

Using the apparatus shown in FIG. 3 for producing an electrophotographic light-receiving member by the RF-PCVD process, a glass substrate (Corning Glass Works, 7059 Glass) and an Si wafer were set on a cylindrical sample holder (outer diameter 80 mm) which was grooved for installing a sample substrate, and an a-Si film having a thickness of about 1 $\mu$m was deposited.

Under conditions in which the ratio (X/Z) of the discharge space volume to the flow rate of an Si supply gas was $5\times10^{-3}$ sccm/$cm^3$, the mixing ratio ($H_2/SiH_4$) of $H_2$ gas to $SiH_4$ gas was 10, the pressure in the discharge space was 65 Pa, and the substrate temperature was 260° C., various a-Si films having a thickness of about 1 $\mu$m were deposited by changing the ratio (Y/X) W/$cm^3$·sccm of the input power density to the $SiH_4$ gas.

On the deposited films formed on the glass substrate, Cr comb-like electrodes were formed after the optical band gap (Eg) were measured, and characteristic energy (Eu) at the exponential tail was measured by CPM. In respect to the deposited films on the Si wafer, the hydrogen content (Ch) and the intensity ratio (Si—$H_2$/Si—H) of absorption peaks of Si—$H_2$ bonds and Si—H bonds were measured by FTIR.

Table 1 shows the relationships between Y/X and Eg, Eu and the ratio Si—$H_2$/Si—H.

Table 1 reveals that, with a ratio Y/X within the range of $3\times10^{-4}$ to $7\times10^{-4}$, Eg is large, and films having low defects can be obtained.

Experimental Example 2

Using the apparatus shown in FIG. 3 for producing an electrophotographic light-receiving member by the RF-PCVD process in the same manner as Example 1 under conditions in which the mixing ratio ($H_2/SiH_4$) of $H_2$ gas to $SiH_4$ gas was 10, the pressure in the discharge space was 60 Pa, the substrate temperature was 260° C., and the ratio (Y/X) of the input power density to the $SiH_4$ gas was $5\times10^{-4}$ W/$cm^3$·sccm, various a-Si films having a thickness of about 1 $\mu$m were deposited by changing the ratio (X/Z) W/$cm^3$·sccm of the discharge space volume to the flow rate of an Si supply gas.

The resultant a-Si films were evaluated by the same method as Example 1. The results shown in Table 2.

Table 2 indicates that, with a ratio X/Z within the range of $3\times10^{-3}$ to $1\times10^{-2}$, Eg is large, and films having low defects can be obtained.

Experimental Example 3

Using the apparatus shown in FIG. 3 for producing an electrophotographic light-receiving member by te RF-PCVD process, a light-receiving member comprising a charge injection blocking layer, a photoconductive layer and a surface layer was formed on a mirror-finished aluminum cylinder (support) having an outer diameter of 80 mm.

The conditions for producing the electrophotographic light-receiving member are shown in Table 3. Various light-receiving members were produced by changing conditions for forming the photoconductive layer in the same manner as Experimental Example 1.

Each of the thus-produced light-receiving members was set in an electrophotographic apparatus (NP-6550 produced by Canon Inc., modified for experiment), and potential characteristics and image properties were evaluated.

In order to evaluate charge performance, the surface potential of each light-receiving member was measured by a potential sensor of a surface potentiometer (TREK Corp. Model 344) which was set at the position of a development unit in the electrophotographic apparatus under conditions in which the process speed was 380 mm/sec, pre-exposure light (LED with a wavelength of 565 nm) was 4 lux·sec, and the charging wire current of a charger was 1000 $\mu$A. To evaluate the temperature-dependent properties, the temperature of a light-receiving member was changed from room temperature (about 25° C.) to 45° C. by the drum heater contained therein, and the charge performance was measured under the above conditions. A change in charge performance per 1° C. temperature change was considered as the temperature-dependent properties.

To evaluate the exposure memory, the surface potential was measured by the same potential sensor as described above under the above conditions in an unexposed state and at the time of re-charging after image exposure using a halogen lamp as an image exposure light source, and a potential difference was measured.

The charge performance, the temperature-dependent properties and the exposure memory were evaluated on the basis of the following criteria.

◎ . . . Very good

○ . . . Good

Δ . . . No practical problem

Table 4 shows the relationships between the ratio Y/X and the charge performance, temperature-dependent properties and exposure memory.

Table 4 reveals that, with Eg of 1.8 eV to 1.85 eV and Eu of 50 meV to 55 meV, i.e., with a ratio Y/X within the range of $3\times10^{-4}$ to $7\times10^{-4}$, all the charge performance, the temperature-dependent properties and the exposure memory are good.

It is also found be necessary that the hydrogen content (Ch) and the intensity ratio (Si—$H_2$/Si—H) of absorption peaks of Si—$H_2$ bonds and Si—H bonds are 25 to 35 atomic % and 0.3 to 0.45, respectively.

EXAMPLES

Although the effect of the present invention will described in detail below with reference to examples, the present invention is not limited to these examples.

Example 1

Using the apparatus shown in FIG. 3 for producing an electrophotographic light-receiving member by the RF-PCVD process, a light-receiving member comprising a charge injection blocking layer, a photoconductive layer and a surface layer was formed on a mirror-finished aluminum cylinder (support) having an outer diameter of 80 mm. The values of Ch, Eg and Eu of the photoconductive layer formed under the conditions in this example were 26 atomic %, 1.8 eV and 54 meV, respectively.

In this example, in the surface layer, the contents of silicon atoms and carbon atoms were non-uniformly distributed in the direction of the thickness thereof.

Table 5 shows the conditions for producing the electrophotographic light-receiving member.

The thus-produced light-receiving member was set in an electrophotographic apparatus (NP-6550 produced by Canon Inc., modified for experiment), and evaluated in potential characteristics by the same method as the experimental examples. As a result, good charge performance, temperature-dependent properties and exposure memory were obtained.

As a result of evaluation of images formed by positively charging the light-receiving member, no exposure memory was observed on the images, and other image characteristics with respect to stained and smeared images were also good.

Namely, even when the contents of the silicon atoms and carbon atoms in the surface layer were distributed non-uniformly in the direction of the thickness thereof, in order to obtain good electrophotographic characteristics, it was found necessary to set Ch, $SiH_2$/Si—H, Eg and Eu the photoconductive layer within the ranges of 25 to 35 atomic %, 0.3 to 0.45, 1.8 eV to 1.85 eV, and 50 meV to 55 meV, respectively.

Example 2

In this example, a surface layer in which the contents of silicon atoms and carbon atoms were distributed non-uniformly in the direction of the thickness thereof was provided, and fluorine atoms were contained in each of a charge injection blocking layer, a photoconductive layer and the surface layer.

Table 6 shows conditions for producing an electrophotographic light-receiving member. Other conditions were the same as Example 1. In this example, the values of Ch, Eg and Eu of the photoconductive layer produced under the conditions shown in Table 6 were 30 atomic %, 1.81 eV and 50 meV, respectively.

The light-receiving member produced was set in an electrophotographic apparatus, and evaluated in potential characteristics in the same manner as Example 1. As a result, good electrophotographic characteristics were obtained, as in Example 1.

The light-receiving member was also positively charged and subjected to image evaluation. As a result, good images were obtained, as in Example 1.

Namely, even when fluorine atoms were contained in each of the layers, in order to obtain good electrophotographic characteristics, it was found necessary to set Ch, Si—$H_2$/Si—H, Eg and Eu of the photoconductive layer within the ranges of 25 to 35 atomic %, 0.3 to 0.45, 1.8 eV to 1.85 eV, and 50 meV to 55 meV, respectively.

Example 3

In this example, carbon atoms were contained in a charge injection blocking layer, and an intermediate layer (an upper blocking layer) containing carbon atoms in a lower content than that of a surface layer and atoms for controlling the conductivity thereof was provided between a photoconductive layer and the surface layer.

Table 7 shows conditions for producing an electrophotographic light-receiving member. Other conditions were the same as Example 1. In this example, the values of Ch, Eg and Eu of the photoconductive layer produced under the conditions shown in Table 7 were 33 atomic %, 1.83 eV and 53 meV, respectively.

The light-receiving member produced was set in an electrophotographic apparatus, and evaluated in potential characteristics in the same manner as Example 1. As a result, good electrophotographic characteristics were obtained, as in Example 1.

The light-receiving member was also negatively charged and subjected to image evaluation. As a result, good images were obtained, as in Example 1.

Namely, even when the intermediate layer (the upper blocking layer) was provided, in order to obtain good electrophotographic characteristics, it was found necessary to set Ch, Si—$H_2$/Si—H, Eg and Eu of the photoconductive layer within the ranges of 25 to 35 atomic %, 0.3 to 0.45, 1.8 eV to 1.85 eV, and 50 meV to 55 meV, respectively.

Example 4

In this example, as a light absorbing layer for preventing occurrence of interference fringes due to the light reflected from a support, an infrared absorbing layer was provided between a support and a charge injection blocking layer.

Table 8 shows conditions for producing an electrophotographic light-receiving member. Other conditions were the same as Example 1. In this example, the values of Ch, Eg and Eu of the photoconductive layer produced under the conditions shown in Table 8 were 26 atomic %, 1.8 eV and 55 meV, respectively.

The light-receiving member produced was set in an electrophotographic apparatus, and evaluated in potential characteristics in the same manner as Example 1. As a result, good electrophotographic characteristics were obtained, as in Example 1.

The light-receiving member was also positively charged and subjected to image evaluation by laser (wavelength 788 nm) image exposure. As a result, good images were obtained, as in Example 1.

Namely, even when the infrared absorbing layer was provided, in order to obtain good electrophotographic characteristics, it was found necessary to set Ch, $SiH_2$/Si—H, Eg and Eu of the photoconductive layer within the ranges of 25 to 35 atomic %, 0.3 to 0.45, 1.8 eV to 1.85 eV, and 50 meV to 55 meV, respectively.

Example 5

In this example, a surface layer in which the contents of silicon atoms and carbon atoms were distributed non-uniformly in the direction of the thickness thereof was provided, and atoms for controlling conductivity, nitrogen atoms and oxygen atoms were contained in the surface layer.

Table 9 shows conditions for producing an electrophotographic light-receiving member. Other conditions were the same as Example 1. In this example, the values of Ch, Eg and Eu of the photoconductive layer produced under the conditions shown in Table 9 were 30 atomic %, 1.81 eV and 52 meV, respectively.

The light-receiving member produced was set in an electrophotographic apparatus, and evaluated in potential characteristics in the same manner as Example 1. As a result, good electrophotographic characteristics were obtained, as in Example 1.

The light-receiving member was also positively charged and subjected to image evaluation. As a result, good images were obtained, as in Example 1.

Namely, even when atoms for controlling conductivity, nitrogen atoms and oxygen atoms were contained the surface layer in which the contents of silicon atoms and carbon atoms were distributed non-uniformly in the direction of the thickness thereof, in order to obtain good electrophotographic characteristics, it was found necessary to set Ch, Si—$H_2$/Si—H, Eg and Eu of the photoconductive layer within the ranges of 25 to 35 atomic %, 0.3 to 0.45, 1.8 eV to 1.85 eV, and 50 meV to 55 meV, respectively.

Example 6

In this example, as constituent atoms of a surface layer, nitrogen atoms were contained in the surface layer in place of carbon atoms.

Table 10 shows conditions for producing an electrophotographic light-receiving member. Other conditions were the same as Example 1. In this example, the values of Ch, Eg and Eu of the photoconductive layer produced under the conditions shown in Table 10 were 25 atomic %, 1.8 eV and 50 meV, respectively.

The light-receiving member produced was set in an electrophotographic apparatus, and evaluated in potential characteristics in the same manner as Example 1. As a result, good electrophotographic characteristics were obtained, as in Example 1.

The light-receiving member was also positively charged and subjected to image evaluation. As a result, good images were obtained, as in Example 1.

Namely, even when as constituent atoms of the surface layer, nitrogen atoms were contained in the surface layer in place of carbon atoms, in order to obtain good electrophotographic characteristics, it was found necessary to set Ch, Si—$H_2$/Si—H, Eg and Eu of the photoconductive layer within the ranges of 25 to 35 atomic %, 0.3 to 0.45, 1.8 eV to 1.85 eV, and 50 meV to 55 meV, respectively.

Example 7

In this example, fluorine atoms, atoms for controlling conductivity, carbon atoms, nitrogen atoms and oxygen atoms were contained in each of a charge injection blocking layer, a photoconductive layer and a surface layer.

Table 11 shows conditions for producing an electrophotographic light-receiving member. Other conditions were the same as Example 1. In this example, the values of Ch, Eg and Eu of the photoconductive layer produced under the conditions shown in Table 11 were 30 atomic %, 1.82 eV and 53 meV, respectively.

The light-receiving member produced was set in an electrophotographic apparatus, and evaluated in potential characteristics in the same manner as Example 1. As a result, good electrophotographic characteristics were obtained, as in Example 1.

The light-receiving member was also positively charged and subjected to image evaluation. As a result, good images were obtained, as in Example 1.

Namely, even when fluorine atoms, atoms for controlling conductivity, carbon atoms, nitrogen atoms and oxygen atoms were contained in each of the charge injection blocking layer, the photoconductive layer and the surface layer, in order to obtain good electrophotographic characteristics, it was found necessary to set Ch, Si—$H_2$/Si—H, Eg and Eu of the photoconductive layer within the ranges of 25 to 35 atomic %, 0.3 to 0.45, 1.8 eV to 1.85 eV, and 50 meV to 55 meV, respectively.

Example 8

In this example, carbon atoms were contained in a photoconductive layer, and the contents of the carbon atoms and atoms for controlling conductivity were distributed non-uniformly in the direction of the thickness of a layer.

Table 12 shows conditions for producing an electrophotographic light-receiving member. Other conditions were the same as Example 1. In this example, the values of Ch, Eg and Eu of the photoconductive layer produced under the conditions shown in Table 12 were 35 atomic %, 1.85 eV and 55 meV, respectively.

The light-receiving member produced was set in an electrophotographic apparatus, and evaluated in potential characteristics in the same manner as Example 1. As a result, good electrophotographic characteristics were obtained, as in Example 1.

The light-receiving member was also positively charged and subjected to image evaluation. As a result, good images were obtained, as in Example 1.

Namely, even when carbon atoms were contained in the photoconductive layer, and a layer region in which the contents of carbon atoms and atoms for controlling conductivity were distributed non-uniformly in the direction of the thickness thereof was provided, in order to obtain good electrophotographic characteristics, it was found necessary to set Ch, Si—$H_2$/Si—H, Eg and Eu of the photoconductive layer within the ranges of 25 to 35 atomic %, 0.3 to 0.45, 1.8 eV to 1.85 eV, and 50 meV to 55 meV, respectively.

Table 13 shows the values of Ch, Si—$H_2$/Si—H, Eg and Eu of the photoconductive layer each of the examples, and Table 14 shows decision criteria in each of the examples.

TABLE 1

| Y/X | $1 \times 10^{-4}$ | $3 \times 10^{-4}$ | $4 \times 10^{-4}$ | $6 \times 10^{-4}$ | $7 \times 10^{-4}$ | $1 \times 10^{-3}$ | $1.5 \times 10^{-3}$ |
|---|---|---|---|---|---|---|---|
| Eg [eV] | 1.75 | 1.80 | 1.82 | 1.83 | 1.85 | 1.85 | 1.85 |
| Eu [meV] | 48 | 50 | 53 | 53 | 55 | 60 | 65 |
| Ch [atom %] | 25 | 30 | 33 | 35 | 40 | 45 | 45 |
| Si—$H_2$/Si—H | 0.2 | 0.3 | 0.35 | 0.35 | 0.45 | 0.5 | 0.6 |

TABLE 2

| X/Z | $1 \times 10^{-3}$ | $3 \times 10^{-3}$ | $5 \times 10^{-3}$ | $1 \times 10^{-2}$ | $1.5 \times 10^{-2}$ |
|---|---|---|---|---|---|
| Eg [eV] | 1.75 | 1.83 | 1.83 | 1.83 | 1.79 |
| Eu [meV] | 58 | 52 | 53 | 55 | 65 |
| Ch [atom %] | 25 | 33 | 35 | 32 | 28 |
| Si—$H_2$/Si—H | 0.18 | 0.32 | 0.35 | 0.4 | 0.6 |

TABLE 3

| | Charge injection blocking layer | Photo-conductive layer | Surface layer |
|---|---|---|---|
| Material gas and flow rate | | | |
| $SiH_4$ (sccm) | 75 | 75 | 10 |
| $H_2$ (sccm) | 500 | 1000 | |
| $B_2H_6$ (ppm) (based on $SiH_4$) | 1500 | 1 | |
| NO (sccm) | 3 | | |
| $CH_4$ (sccm) | | | 500 |
| Support temperature (° C.) | 260 | 260 | 260 |
| Internal pressure (Pa) | 65 | 65 | 65 |
| Power density (W/cm3) | $9 \times 10^{-3}$ | According to Experimental Example 1 | $1.2 \times 10^{-2}$ |
| Layer thickness (μm) | 2 | 30 | 0.5 |

TABLE 4

| Y/X | $1 \times 10^{-4}$ | $3 \times 10^{-4}$ | $4 \times 10^{-4}$ | $6 \times 10^{-4}$ | $7 \times 10^{-4}$ | $1 \times 10^{-3}$ | $1.5 \times 10^{-3}$ |
|---|---|---|---|---|---|---|---|
| Charge performance | Δ | ○ | ◎ | ◎ | ◎ | ○ | ○ |
| Temperature-dependent properties | ◎ | ◎ | ◎ | ◎ | ○ | ○ | Δ |
| Exposure memory | ◎ | ◎ | ◎ | ◎ | ○ | Δ | Δ |

TABLE 5

| | Charge injection blocking layer | Photo-conductive layer | Surface layer |
|---|---|---|---|
| Material gas and flow rate | | | |
| $SiH_4$ (sccm) | 350 | 150 | 200 →10→10 |
| $H_2$ (sccm) | 500 | 2000 | |
| $B_2H_6$ (ppm) (based on $SiH_4$) | 1500 | 1 | |
| NO (sccm) | 10 | | |
| $CH_4$ (sccm) | | | 50→600→700 |
| Support temperature (° C.) | 270 | 260 | 250 |
| Internal pressure (Pa) | 40 | 55 | 60 |
| Power density (W/cm$^3$) | $1 \times 10^{-2}$ | $4.5 \times 10^{-2}$ | $9.1 \times 10^{-3}$ |
| Layer thickness (μm) | 3 | 30 | 0.5 |

TABLE 6

| | Charge injection blocking layer | Photo-conductive layer | Surface layer |
|---|---|---|---|
| Material gas and flow rate | | | |
| $SiH_4$ (sccm) | 350 | 100 | 200→10→10 |
| SiF (sccm) | 5 | 1 | 5 |
| $H_2$ (sccm) | 500 | 2000 | |
| $B_2H_6$ (ppm) (based on $SiH_4$) | 1500 | 1 | |
| NO (sccm) | 10 | | |
| $CH_4$ (sccm) | | | 50→600→700 |
| Support temperature (° C.) | 270 | 260 | 250 |
| Internal pressure (Pa) | 55 | 60 | 70 |
| Power density (W/cm$^3$) | $3 \times 10^{-2}$ | $4 \times 10^{-2}$ | $9.1 \times 10^{-3}$ |

TABLE 6-continued

| | Charge injection blocking layer | Photo-conductive layer | Surface layer |
|---|---|---|---|
| Layer thickness ($\mu$m) | 3 | 30 | 0.5 |

TABLE 7

| | Charge injection blocking layer | Photo-conductive layer | Intermediate layer | Surface layer |
|---|---|---|---|---|
| Material gas and flow rate | | | | |
| $SiH_4$ (sccm) | 150 | 100 | 100 | 10 |
| $H_2$ (sccm) | 500 | 800 | | |
| $PH_3$ (ppm) (based on $SiH_4$) | 1000 | | | |
| $B_2H_6$ (ppm) (based on $SiH_4$) | | 0.2 | 500 | |
| $CH_4$ (sccm) | 20 | | 300 | 500 |
| Support temperature (° C.) | 250 | 250 | 250 | 250 |
| Internal pressure (Pa) | 70 | 70 | 40 | 40 |
| Power density (W/cm$^3$) | $1.8 \times 10^{-2}$ | $3.6 \times 10^{-2}$ | $1.8 \times 10^{-2}$ | $1.2 \times 10^{-2}$ |
| Layer thickness ($\mu$m) | 2 | 30 | 0.1 | 0.5 |

TABLE 8

| | IR absorbing layer | Charge injection blocking layer | Photo-conductive layer | Surface layer |
|---|---|---|---|---|
| Material gas and flow rate | | | | |
| $SiH_4$ (sccm) | 200 | 200 | 75 | 200→15→10 |
| $GeH_4$ (sccm) | 50 | | | |
| $H_2$ (sccm) | 800 | 800 | 1000 | |
| $B_2H_6$ (ppm) (based on $SiH_4$) | 2000 | 2000 | 1 | |
| NO (sccm) | 15→10 | 10 | | |
| $CH_4$ (sccm) | | | | 0→500→600 |
| Support temperature (° C.) | 280 | 280 | 280 | 280 |
| Internal pressure (Pa) | 40 | 40 | 65 | 60 |
| Power density (W/cm$^3$) | $1.2 \times 10^{-2}$ | $1.8 \times 10^{-2}$ | $3.6 \times 10^{-2}$ | $7.3 \times 10^{-3}$ |
| Layer thickness ($\mu$m) | 1 | 2 | 25 | 0.5 |

TABLE 9

| | Charge injection blocking layer | Photo-conductive layer | Surface layer |
|---|---|---|---|
| Material gas and flow rate | | | |
| $SiH_4$ (sccm) | 150 | 50 | 300→15→10 |
| $H_2$ (sccm) | 1000 | 600 | |
| $B_2H_6$ (ppm) (based on $SiH_4$) | 3000 | 1.5 | 1 |
| NO (sccm) | 10 | | 1 |
| $CH_4$ (sccm) | 5 | | 0→550→600 |
| Support temperature (° C.) | 300 | 300 | 300 |
| Internal pressure (Pa) | 40 | 80 | 40 |
| Power density (W/cm$^3$) | $3 \times 10^{-2}$ | $2.5 \times 10^{-2}$ | $1.8 \times 10^{-2}$ |
| Layer thickness ($\mu$m) | 2 | 30 | 0.5 |

TABLE 10

| | Charge injection blocking layer | Photo-conductive layer | Surface layer |
|---|---|---|---|
| Material gas and flow rate | | | |
| $SiH_4$ (sccm) | 300 | 100 | 20 |
| $H_2$ (sccm) | 500 | 1500 | |
| $B_2H_6$ (ppm) (based on $SiH_4$) | 3000 | 3 | |
| NO (sccm) | 5 | | |
| $NH_3$ (sccm) | | | 300 |
| Support temperature (° C.) | 290 | 290 | 250 |
| Internal pressure (Pa) | 65 | 55 | 65 |
| Power density (W/cm$^3$) | $1.8 \times 10^{-2}$ | $5.6 \times 10^{-2}$ | $6.1 \times 10^{-3}$ |
| Layer thickness ($\mu$m) | 3 | 25 | 0.3 |

TABLE 11

| | Charge injection blocking layer | Photo-conductive layer | Surface layer |
|---|---|---|---|
| Material gas and flow rate | | | |
| $SiH_4$ (sccm) | 150 | 125 | 330→15→10 |
| $SiF_4$ (sccm) | 20 | 10 | 5 |
| $H_2$ (sccm) | 1000 | 1500 | |
| $B_2H_6$ (ppm) (based on $SiH_4$) | 3000 | 3 | 5 |
| NO (sccm) | 10 | 2 | 1 |
| $CH_4$ (sccm) | 5 | 2 | 0→550→600 |
| Support temperature (° C.) | 300 | 300 | 300 |
| Internal pressure (Pa) | 45 | 60 | 60 |
| Power density (W/cm$^3$) | $3 \times 10^{-2}$ | $7.5 \times 10^{-2}$ | $1.8 \times 10^{-2}$ |
| Layer thickness ($\mu$m) | 2 | 30 | 0.5 |

TABLE 12

| | Charge injection blocking layer | Photo-conductive layer | Surface layer |
|---|---|---|---|
| Material gas and flow rate | | | |
| $SiH_4$ (sccm) | 100 | 50 | 200→10→10 |
| $H_2$ (sccm) | 500 | 400 | |
| $B_2H_6$ (ppm) (based on $SiH_4$) | 1000 | 10→1 | |
| $CH_4$ (sccm) | 50 | 10→0 | 0→550→600 |
| Support temperature (° C.) | 250 | 250 | 250 |
| Internal pressure (Pa) | 65 | 65 | 40 |
| Power density (W/cm$^3$) | $3 \times 10^{-2}$ | $3.2 \times 10^{-2}$ | $6.1 \times 10^{-3}$ |
| Layer thickness (μm) | 3 | 25 | 0.5 |

TABLE 13

| | Eg [eV] | Eu [meV] | Ch [atom %] | Si—$H_2$/Si—H |
|---|---|---|---|---|
| Example 1 | 1.80 | 54 | 26 | 0.38 |
| Example 2 | 1.81 | 50 | 30 | 0.3 |
| Example 3 | 1.83 | 53 | 33 | 0.4 |
| Example 4 | 1.80 | 55 | 26 | 0.45 |
| Example 5 | 1.81 | 52 | 30 | 0.35 |
| Example 6 | 1.80 | 50 | 25 | 0.32 |
| Example 7 | 1.82 | 53 | 30 | 0.39 |
| Example 8 | 1.85 | 55 | 35 | 0.44 |

TABLE 14

| | ⊚ | ○ | Δ |
|---|---|---|---|
| Charge performance | 17 V/μm or more | 15~17 V/μm | 13~15 V/μm |
| Temperature-dependent properties | ±1 V/deg or less | ±1 V/deg~±3 V/deg | ±3 V/deg~±5 V/deg |
| Exposure memory | ±5 V or less | ±5 V~±7 V | ±7 V~±10 V |

(Charge performance is indicated by a value (V/μm) per micrometer of photoconductive layer.)

According to the present invention, the electrophotographic light-receiving member has high charge performance, the temperature-dependent properties in the service temperature region thereof can remarkably be improved, and the occurrence of exposure memory can be prevented. Hence, it is possible to obtain an electrophotographic light-receiving member which has improved stability to service environments, and which can stably produce high-quality images having sharp halftone and high resolution.

Accordingly, the electrophotographic light-receiving member of the present invention having the above-described specified construction is capable of solving all problems of conventional electrophotographic light-receiving members comprising a-Si, and exhibits very excellent electrical properties, optical properties, photoconductive properties, image properties, durability and service environmental properties.

In particular, since the photoconductive layer comprises a-Si in which its optical band gap is enlarged, and the levels in the gap are significantly decreased in number, the light-receiving member exhibits high charge performance which less changes with changes in surrounding environments, substantially negligible exposure memory, and very excellent potential characteristics and image properties.

What is claimed is:

1. A process for producing an electrophotographic light-receiving member comprising a conductive support and a light-receiving member having a photoconductive layer formed on the surface of the conductive support and composed of a non-single crystal material containing silicon atoms as a main component and hydrogen atoms and/or halogen atoms, said process comprising: vacuum depositing said photoconductive layer in an apparatus which includes a reactor provided with a substrate and a discharge space, a raw material supply device and a RF power source under high frequency plasma vapor deposition (RF-PCVD) conditions in which the flow rate (X) sccm of a Si supply gas and a discharge space volume (Z) cm$^3$ satisfy the following relation (A) and a flow rate (X) sccm of the Si supply gas and density (Y) W/cm$^3$ of the electric power input to the discharge space satisfy the following relation (B)

$$3\times10^{-3} \leqq X/Z \leqq 1\times10^{-2} \quad \text{(A)}$$

$$3\times10^{-4} \leqq Y/X \leqq 7\times10^{-4} \quad \text{(B).}$$

2. A process for producing an electrophotographic light-receiving member according to claim 1, comprising forming said photoconductive layer under conditions in that the flow rate (X) sccm of the Si supply gas and the density (Y) W/cm$^{-3}$ of the electric power input to a discharge space satsify the following relation (C)

$$4\times10^{-4} \leqq Y/X \leqq 6\times10^{-4} \quad \text{(C).}$$

* * * * *

UNITED STATES PATENT AND TRADEMARK OFFICE

CERTIFICATE OF CORRECTION

PATENT NO. : 6,632,578 B2
DATED : October 14, 2003
INVENTOR(S) : Niino et al.

It is certified that error appears in the above-identified patent and that said Letters Patent is hereby corrected as shown below:

Title page,
Item [30], Foreign Application Priority Data, "7/350769" should read -- 7-350769 -- and "8/337662" should read -- 8-337662 --.

Column 1,
Line 27, "use" should read -- use is --.

Column 9,
Line 19, "reactor" should read -- reactor, --.
Line 59, "used" should read -- be used --.

Column 17,
Line 23, "5 $\mu$M," should read -- 5 $\mu$m, --.
Line 24, "$\mu$m," should read -- $\mu$m.--.

Column 21,
Line 35, "be" should be deleted.

Signed and Sealed this

Twenty-second Day of June, 2004

JON W. DUDAS
*Acting Director of the United States Patent and Trademark Office*